US006690760B2

(12) United States Patent
Kolster

(10) Patent No.: US 6,690,760 B2
(45) Date of Patent: Feb. 10, 2004

(54) UNIT COUNTING DEVICE

(76) Inventor: Emmett Kolster, 10496 SW. Hwy. 116, Lathrop, MO (US) 64465

( * ) Notice: Subject to any disclaimer, the term of this patent is extended or adjusted under 35 U.S.C. 154(b) by 0 days.

(21) Appl. No.: 10/106,634

(22) Filed: Mar. 26, 2002

(65) Prior Publication Data

US 2003/0185335 A1 Oct. 2, 2003

(51) Int. Cl.[7] ..... G06M 9/00
(52) U.S. Cl. ..... 377/6; 377/7; 377/11
(58) Field of Search ..... 377/6, 7, 11

(56) References Cited

U.S. PATENT DOCUMENTS 4,178,502 A * 12/1979 Zimmermann ..... 235/92
4,680,464 A 7/1987 Bross
4,982,412 A 1/1991 Gross
6,078,635 A * 6/2000 DuBois ..... 377/6
6,219,798 B1 4/2001 Choi
6,370,216 B1 * 4/2002 Lawandy et al. ..... 377/8
6,377,648 B1 * 4/2002 Culbert ..... 377/6

* cited by examiner

*Primary Examiner*—Margaret R. Wambach
(74) *Attorney, Agent, or Firm*—Chase Law Firm, L.C.

(57) ABSTRACT

A counting device with control system includes a housing with a rotating wheel therein. The wheel includes a plurality of seats for each item to be counted. Upon deposit of the items into the housing, each item is seated for discharge through a housing aperture, past a sensor operating a counter and onto a conveyor line. A baffle adjacent the housing aperture directs the counted items to one or the other longitudinal side of the conveyor line. A control system controls the baffle position according to a preselected item count. An air pressure system assures a proper seating of each items and discharge through the housing aperture.

22 Claims, 3 Drawing Sheets

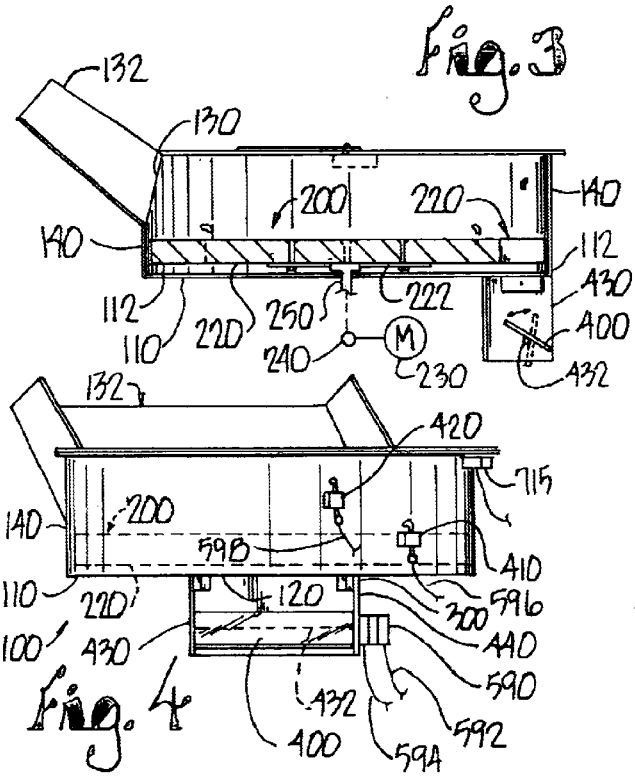
Fig. 3
Fig. 4
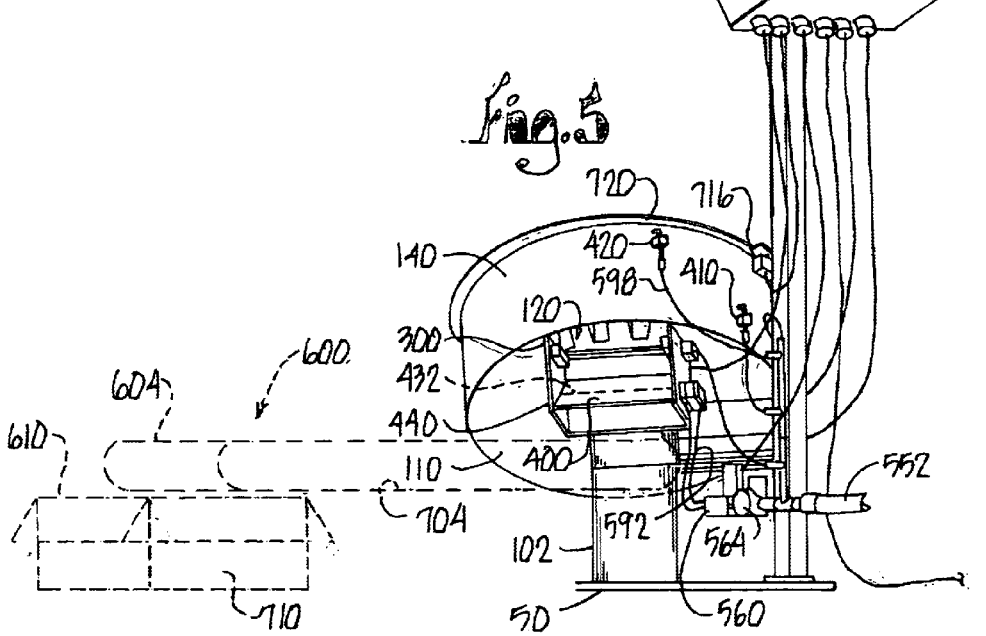
Fig. 5

UNIT COUNTING DEVICE

BACKGROUND OF THE INVENTION

This invention relates to a device for counting items and, more particularly, a device for regulating the deposit of a preselected count of items into alternate containers.

Heretofore, a selected number of items have been manually counted and packed into a carton to achieve a desired item count. Alternatively, the carton is packed with items until a preselected weight is achieved corresponding to the weight of the desired number of items to be packed in the carton. Obviously one problem with the physical count is the manual labor involved. A problem with the weight method is that undesirable variances in the number of units per box arise.

In response thereto I have invented a counting device having a housing which receives a plurality of items from an upstream location, and positions each item for discharge from the housing past an electronic counter. The counted item is directed onto a selected side of a conveyor belt for deposit into a carton positioned at that end of the conveyor line. Upon the counter reaching a preselected item count, an air-operated baffle directs the subsequent items being discharged from the housing onto an opposed side of the belt for deposit into a second carton. Upon a selected carton being filled, it is removed by the worker and replaced with an empty carton on that side of the line. This process is repeated until all items are counted and packed into cartons.

My device generally comprises a cylindrical housing having a rotating wheel therein. The wheel includes a number of slots forming a seat. Upon wheel rotation each slot aligns with an aperture in the base of the housing causing the seated item to fall through the base and past a sensor which increments an electronic counter. Spanning the housing aperture is the air-operated baffle which rotates between first and second positions so as to direct the discharged items onto the appropriate side of an underlying conveyor line. A control system compares the incremented count with a preset count so as to provide for baffle rotation and energizes a warning alarm indicative of a filled carton. The system also assures that an empty container is in place for subsequent receipt of counted items.

It is therefore a general object of this invention to provide an improved counting device.

Another object of this invention is to provide a device, as aforesaid, which directs the counted items to a downstream location for deposit in a container.

A further object of this invention is to provide a counting device, as aforesaid, which directs the counted items into seats within a housing for sequential discharge from the housing.

Another further object of this invention is to provide a counting device, as aforesaid, wherein the seats are in a wheel which rotates the items into alignment with a housing aperture for discharge of each item through the aperture and past a sensor associated with a counter.

Still a further object of the invention is to provide a counting device, as aforesaid, which utilizes air pressure to guide each item into a selected seat for subsequent counting.

Another object of this invention is to provide a counting device, as aforesaid, which utilizes an air-operated baffle to direct the discharged items to alternate downstream locations for deposit into alternate downstream containers.

A particular object of this invention is to provide a counting device, as aforesaid, wherein a warning signal is generated indicative that a container has a desired number of counted units therein.

Another particular object of this invention is to provide a counting device, as aforesaid, which includes a control system for regulating baffle rotation and to assure that an empty container is in position for deposit of the counted items therein.

Other objects and advantages of this invention will become apparent from the following description taken in connection with the accompanying drawings, wherein is set forth by way of illustration and example, a now preferred embodiment of my invention.

DESCRIPTION OF THE DRAWINGS

FIG. 3 is a sectional view of the housing of my device taken along line 3—3 in FIG. 2;

FIG. 4 is a front view of the housing of my device;

FIG. 5 is a view of my device with a conveyor belt shown in phantom lines therebelow;

DESCRIPTION OF THE PREFERRED EMBODIMENT

Figures 1, 2:
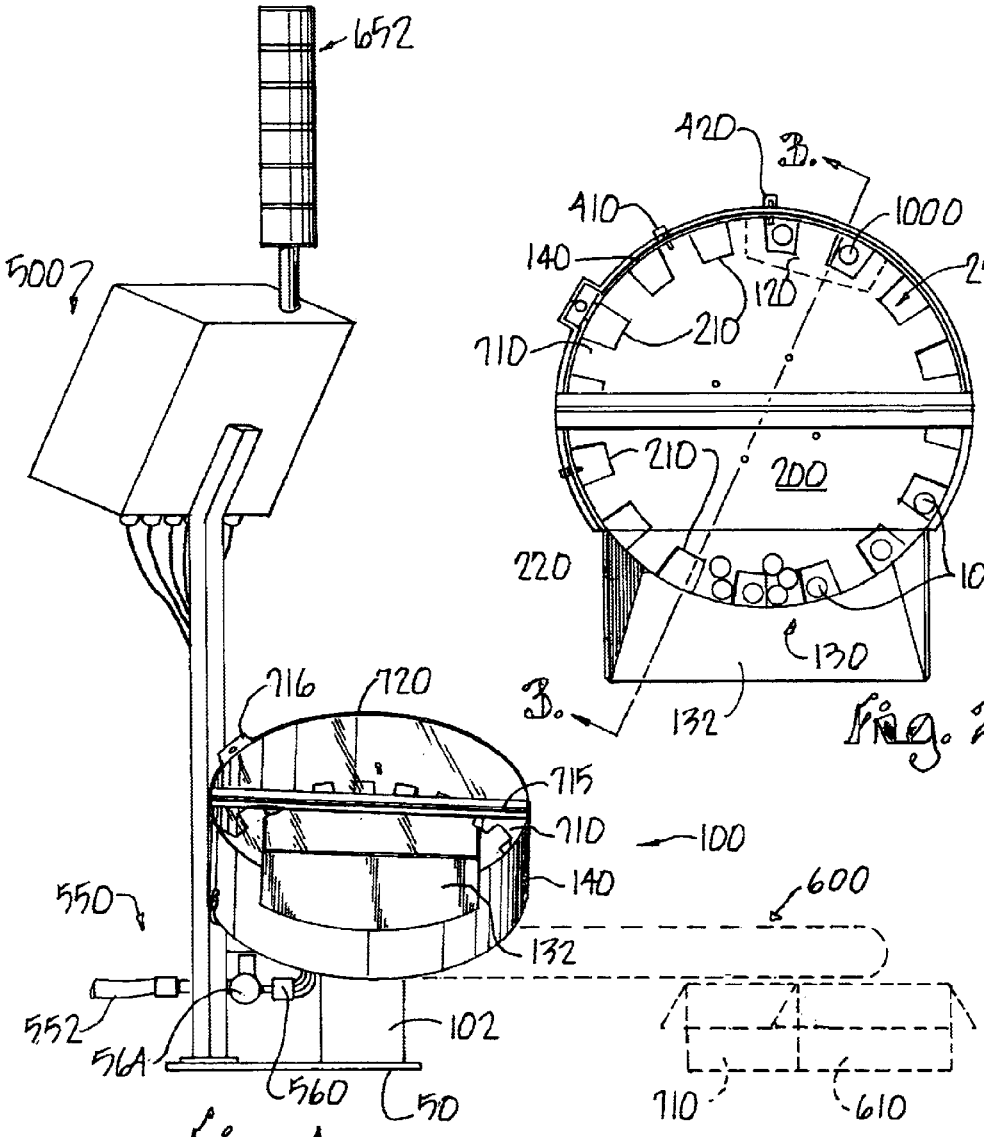
FIG. 1 is an elevation view of my item counting device with a conveyor belt shown in phantom.
FIG. 2 is a top view of the housing of my device.

Turning more particularly to the drawings, FIG. 1 shows my device as generally comprising a support base 50, a housing 100, a control housing 500 for an electronic control system and an air pressure system 550.

The housing comprises a tub/cylindrical housing 100 supported on column 102 extending from base 50. Housing 100 has a base 110 with aperture 120 therein. A vertical wall 140 surrounds the base 110. A scoop 132 communicates with an inlet 130 within the housing wall 140. The scoop 132 receives items to be counted from an upstream location. A two-piece lid 710, 720 rotatable about shaft 715 covers the top of housing 100. An opening of the lid ceases delivery of power to the system via cutoff switch 716. For purposes of illustration and not limitation, the drawings show a plastic bottle cap 1000 for counting. It is understood that my invention need not be limited to the type of unit counted.

The base 110 has a raised circular ridge 112 (FIG. 3) about its circumference which raises the underside 220 of a driven wheel 200 from base 110. Within wheel 200 are a plurality of notches/slots 210 which cooperates with the housing base 110 and interior surface of wall 140 to form a seat 220 for one cap 1000 to be counted. (Apertures in the wheel may also be used in lieu of notches.) As diagrammatically shown (FIG. 3), wheel 200 is driven by a motor 230 as attached to a gearbox 240 having a 10:1 gear ratio on the underside of housing. A shaft 250 extends from the gearbox and is attached to a circular plate 222 which is attached to the wheel 200. It is understood that various forms of transmission of the energy from the motor 230 to the shaft 250 and connection of shaft 250 to wheel 200 may be used. As such, operation of the motor 230 drives the gearbox 240 which in turn rotates wheel 200 within the housing 100.

Upon deposit of the caps into the tilted housing 100 via scoop 132 and inlet 130, the caps 1000 seek the lower end of the tilted housing 100. The aperture 120 in the housing base 110 is at the raised end of the tilted base 110. Accordingly, each cap 1000 will be initially guided by gravity to the lower end. Rotation of wheel 200 guides a cap 1000 into one of the seats 220 as formed by the slot 210, housing base 110 and wall 140. The motor driven rotation of the wheel 200 directs the seated items 1000 towards the higher aperture 120 in base 100. Upon alignment of the base aperture 120 with a respective seat 220, the seated item 1000 falls through the aperture 120. An air pressurized jet 410 urges each item into the seat 220 upon movement of the seat 220 under the jet 410. Also, an air pressurized jet 420 urges the item 1000 through apertures 120 upon alignment of the seat 220 with aperture 120.

Upon discharge through the aperture 120, the item passes a sensor 300 which electronically increments a counter 510 in the central housing 500. It is understood that a counter itself may be placed at this position. Of importance is that an item falling through aperture 120 increments a counter whether located adjacent this aperture 120 or displaced therefrom. Therefore, unless otherwise noted, I use this term to mean either the sensor 300/counter 510 combination as shown or a counter itself adjacent the aperture 120. Adjacent the sensor/counter 300 is a baffle 400 which is rotatable between first and second positions. Baffle 400 is mounted in a chute having depending walls 430, 440 and about a shaft 432 extending between the walls. In the first solid line position (FIG. 3) the baffle 400 directs the discharged item 1000 onto a first longitudinal side 604 of an underlying conveyor belt 600 which will transport the counted item thereon to a downstream location for deposit into a container 610 at the end of the conveyor line on that side thereof.

Upon the counter 300 reaching a preselected count, an air pressure system 550 rotates the baffle 400 to a second phantom line position (FIG. 3) which direct a counted item to an opposed longitudinal side 704 of the underlying conveyor belt 600. The items deposited on the side 704 of the conveyor line will then be transported downstream for deposit into a second downstream container 710 at the opposed end of the conveyor line. (FIG. 5 shows the opposed ends of the conveyor belt 600 as being offset for purposes of illustration.) Thus, my device first fills up container 610 with the desired number of counted units and then container 710 with a similar number of counted units. This baffle 400 movement continues until all the items 1000 are received from the upstream location via inlet 130, discharged past counter 300 and deposited into alternating cartons 610, 710. Alternatively, the chute itself may be movable between first and second positions instead of using baffle 400 therein so as to direct the counted items to alternative downstream locations.

The air system 550 includes air pressure source 552, air pressure regulator 564, air pressure measurement device 560 and an air pressure baffle valve 590. Air paths via first and second hoses 592, 594 communicate with an air baffle valve 590. These hoses 592, 594 terminate on opposed sides of a rotatable baffle within air baffle valve 590 which is connected to the shaft 432 of baffle 400. A blast of air from hose 592 rotates the baffle valve in a first direction which rotates baffle 400 to the FIG. 3 solid line position. A blast of air from hose 594 rotates baffle valve 590 to an opposed second position which rotates baffle 400 to the phantom line position. Thus, as the baffle in air baffle valve 590 is rotated by air pressure, the baffle 400 likewise rotates between corresponding first and second positions.

Hoses 596, 598 likewise deliver a steady stream of pressurized air to jets 410, 420 which urges the item 1000 into a seat and out the aperture. If the air pressure at 560 falls below a predetermined value, a signal is generated which ceases power to the motor 230 so as to shut down the system.

Figure 6:
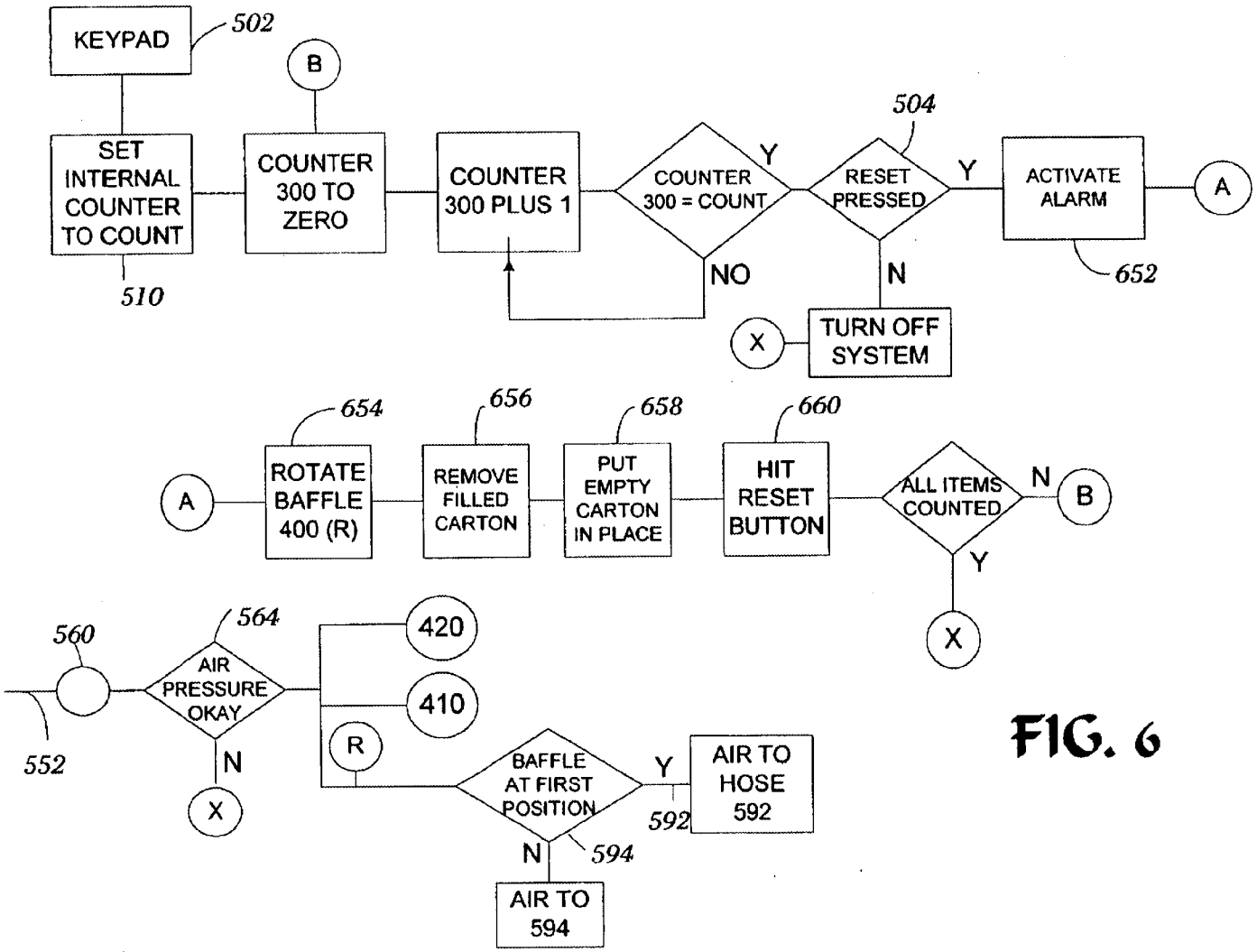
FIG. 6 is a diagram showing operation of the air pressure and control systems for my counting device.

One form of a microprocessor control system 500 which incorporates this air system is diagrammatically shown in FIG. 6. As shown, a preselected count is set into an internal counter 510 via key pad 502. As items pass sensor 300, the sensor/counter 300 is incremented by one. The discharged item counter 300 count is then compared to the preset internal counter count 510. If this count is not equal, the system continues to operate. If yes, the preset number of units per carton has been achieved. The system checks to see if a reset button 504 on control panel 580 has been reset by a user. If so, the alarm 652 is energized and baffle 400 is rotated at 654 to its opposed position via a blast of air through hoses 592 or 594 as above described. As a container is filled, the user then removes this filled container 656 and puts an empty container 658 in place. He then hits reset button 504 indicative that this task has been achieved. As the baffle 400 has been rotated to its second position, the other container is being filled. Before subsequent rotation of baffle 400, the reset button 504 is checked. If not reset, the system shuts down. This precludes a baffle 400 from rotating to an opposed position and deliver items to a side of the conveyor line having no empty carton in place.

It is understood that other forms of control system logic may be used with my device. Also, it is understood that a conveyor need not be used with my device as the alternate downstream locations may differ, e.g., alternate containers located directly below the discharge chute.

Having above described and illustrated, my above-described invention it is understood that my invention is not limited thereto except as below claimed and allowable functional equivalents thereof.

Having thus described the invention, what is claimed as new and desired to be secured by Letters Patent is:

1. A counting device for a plurality of items comprising:

a housing presenting a base;

an aperture in said base;

an inlet in said housing for deposit of the items to be counted into the housing;

a rotatable member within said housing;

a plurality of apertures in said rotatable member, each aperture for seating one of the items to be counted therein;

means for counting an item passing through said base aperture, said counting means incrementing an item count in response to an item passing through said base aperture;

means for rotating said rotatable member, said rotation aligning one of said rotatable member apertures with said base aperture, said alignment causing the item seated in said rotatable member aperture to fall through said base aperture aligned therewith, said counting means responsive to an item passing through said base aperture for incrementing the item count;

a baffle adjacent said base aperture:

means for moving said baffle between first and second positions upon the item count reaching a preselected count, said baffle at said first position regulating the movement of the item to a first location, said baffle at said second position regulating the movement of the item to a second location.

2. The device as claimed in claim 1 further comprising a conveyor line below said housing aperture for delivering the counted item to a downstream location, said baffle directing the item to first or second locations on said conveyor line according to said first or second baffle positions.

3. The device as claimed in claim 1 wherein said means for moving said baffle between said first and second position comprises:

a valve having a member therein movable between first and second valve positions;

means for connecting said valve to said baffle;

means for moving said valve member between said first and second valve positions said valve movement moving said baffle connected thereto between said baffle first and second positions.

4. The device as claimed in claim 3, wherein said means for moving said valve member comprises:

a pressurized air supply;

a pair of hoses connected to said pressurized air supply, said hoses alternately directing pressurized air onto said valve member for movement into said first or second positions corresponding to said first or second positions of said baffle.

5. The device as claimed in claim 1 further comprising means for urging an item into one of said rotatable member apertures.

6. The device as claimed in claim 5, wherein said urging means comprise:

a pressurized air supply;

a first jet;

a first hose for delivering the pressurized air from said air supply to said first jet, said first jet directing said pressurized air into said housing to urge an item into one of said rotatable member apertures.

7. The device as claimed in claim 1 further comprising means for enhancing said fall of the items through said base aperture.

8. The device as claimed in claim 7 wherein said enhancing means comprises:

an air supply;

a jet;

a hose for delivering the air to said jet for directing air toward said wheel aperture in alignment with said base aperture, whereby to enhance the fall of the item in said aligned wheel aperture through said base aperture.

9. The device as claimed in claim 1, further comprising a control system including:

an internal counter containing a preselected count;

means for activating said baffle moving means, said activating means responsive to a match of said preselected and counting means counts to activate said baffle moving means, whereby to move said baffle from said previous first or second position to a subsequent second or first position.

10. The device as claimed in claim 9, further comprising alarm means indicative of said movement of said baffle between said previous and subsequent positions.

11. The device as claimed in claim 1, wherein said rotatable member apertures are a plurality of notches about a perimeter of said rotatable member, said notches cooperating with said housing to present a plurality of seats about said rotatable member.

12. A counting device for a plurality of items comprising:

a housing presenting a base;

an aperture in said base;

an inlet in said housing for deposit of the items to be counted therein;

a rotatable member within said housing;

a plurality of seats in said rotatable member, each seat for one of the plurality of items therein;

means for rotating said member about an imaginary axis, said rotation aligning one of said seats with said base aperture, said alignment allowing for the item within said aligned seat to pass through said base aperture;

means for counting adjacent said base aperture and incremental in count according to each item passing through said base aperture;

means for directing each item passing through said base aperture from one preselected location to another location upon said counting means count reaching a preselected count.

13. The device as claimed in claim 12, wherein said directing means comprises:

a baffle outside said base aperture;

means for rotating said baffle between first and second positions upon said counting means reaching said preselected count, said baffle at said first position directing the item to said one preselected location and at said second position for directing the item to said another location.

14. The device as claimed in claim 13, wherein said one location comprises a container for receipt of counted items therein and said another location comprises a second container for receipt of the counted items therein.

15. The device as claimed in claim 14, further comprising a conveyor line intermediate said baffle and said locations, said conveyor transporting the counted items to either said one or another location.

16. A counting device for a plurality of items comprising:

a housing presenting a base;

an aperture in said base;

a member within said housing;

a plurality of seats in said member for receipt of one of the items therein;

means for moving each said member seat into alignment with said base aperture, said alignment discharging the item within said aligned seat through said base aperture;

means for moving the item in said alignment seat through said base aperture;

means for counting the items discharged through the base aperture;

means for directing the discharged items from a first location to a second location upon said counting means reaching a preselected count.

17. The device as claimed in claim 16, further comprising:

a conveyor line downstream said base aperture for receiving the discharged items thereon, said conveyor line including said first or second locations thereon.

18. The device as claimed in claim 17, wherein a first longitudinal side of the conveyor line corresponds to said first location and a second opposed longitudinal side of the conveyor line corresponds to said second location and further comprising:

a first container at an end of said first side of the conveyor line;

a second container at an end of said second side of the conveyor line, said conveyor line directing the discharged items thereon to said first or second containers.

19. A counting device for a plurality of items comprising:

a housing presenting a base;

an aperture in said base;

an inlet in said housing for deposit of the items to be counted into said housing;

means within said housing for seating at least one of the deposited items to be counted therein;

means for incrementing an item count in response to an item passing into said base aperture;

means for aligning the at least one of the seated items to be counted in said seating means with said base aperture, said alignment causing the seated item to fall into said base aperture aligned therewith, whereby said counting means increments the item count;

means associated with said base aperture for directing the item falling into said base aperture from a first location relative to said base aperture to a second location relative to said base aperture upon said item count reaching a preselected item count.

20. The counting device as claimed in claim 19 further comprising means for enhancing said seating of at least one of the items deposited into said housing by said seating means.

21. The counting device as claimed in claim 20 further comprising means for urging an item seated in said seating means through said base aperture upon said alignment therebetween.

22. The counting device as claimed in claim 19 further comprising means for urging an item seated in said seating means through said base aperture upon said alignment therebetween.

* * * * *

UNITED STATES PATENT AND TRADEMARK OFFICE

CERTIFICATE OF CORRECTION

PATENT NO. : 6,690,760 B2
DATED : February 10, 2004
INVENTOR(S) : Emmett Kolster It is certified that error appears in the above-identified patent and that said Letters Patent is hereby corrected as shown below:

Column 5,
Line 16, after "into said first or second" insert -- valve --.
Line 32, delete "items" and substitute -- item --.
Line 38, after "directing" insert -- the --.

Column 6,
Line 23, after "receipt of" insert -- the --.

Signed and Sealed this

Twenty-ninth Day of June, 2004

JON W. DUDAS
*Acting Director of the United States Patent and Trademark Office*